US008277235B2

(12) United States Patent
Lu

(10) Patent No.: US 8,277,235 B2
(45) Date of Patent: Oct. 2, 2012

(54) SOCKET AND MOTHERBOARD WITH THE SAME

(75) Inventor: Tung-Ke Lu, Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 0 days.

(21) Appl. No.: 12/906,621

(22) Filed: Oct. 18, 2010

(65) Prior Publication Data

US 2012/0094506 A1 Apr. 19, 2012

(51) Int. Cl.
*H01R 13/62* (2006.01)

(52) U.S. Cl. ..... 439/160; 439/157

(58) Field of Classification Search ..... 439/160, 439/157, 327, 328
See application file for complete search history.

(56) References Cited

U.S. PATENT DOCUMENTS 5,181,857 A * 1/1993 Layser ..... 439/157
5,603,625 A * 2/1997 Tondreault ..... 439/157
2003/0137811 A1* 7/2003 Ling et al. ..... 361/759
* cited by examiner

*Primary Examiner* — Ross Gushi
(74) *Attorney, Agent, or Firm* — Chun-Ming Shih

(57) ABSTRACT

A socket for selectively mounting on a board includes a housing and a latch. The housing includes a first side plate and a second side plate parallel to the first side plate. The first and second side plates define an elongated slot therebetween for reception of the board. The latch includes an axle, a body and a fastening portion. The axle is pivotably coupled to the housing at one end of the slot. The body has one end joined to the axle and the other end to the fastening portion. The fastening portion is constructed for engagement with the board. In addition, the lateral width of the body of the latch in the direction along the width of the first side plate is smaller than that of the axle in the same direction.

9 Claims, 8 Drawing Sheets

SOCKET AND MOTHERBOARD WITH THE SAME

BACKGROUND OF INVENTION

1. Field of Invention

The present invention relates to a socket and a motherboard using the socket, and in particular to a latch structure of the socket.

2. Related Prior Art

Electrical sockets for mounting a plurality of circuit board cards on a motherboard are well known in the industry. The circuit board cards may be interface cards, adapter cards or other types of circuit board, such as single in-line memory modules (SIMM) or dual inline memory modules (DIMM). The circuit board cards may also be test boards or other types of board with specific functions. In order to ensure that the circuit board cards are maintained in position in the sockets and well electrically engaging with contacts of the sockets, a number of latches are provided on ends of the sockets.

A conventional motherboard, prior to that patent, is equipped with a number of memory sockets that are arranged side by side and spaced apart on the circuit board. In doing so, gaps between each two memory sockets are unused and become a waste of the motherboard. For this, some techniques are provided to solve the forgoing problems as following.

With the miniaturization of the electronic devices, dimensions of the circuit boards installed in the electronic devices are confined more or less. The electronic devices may be desktop computers, laptop computers, server computers or the like. Due to the tight space limits, the conventional server motherboard 9, as shown in FIG. 7, has its memory sockets 90 divided into two groups side by side along a longitudinal direction. Further, the three memory sockets 90 in each group are arranged side by side along a lateral direction and spaced apart from one another. Besides, each of the three memory sockets 90 in one group is oriented end to end and in close proximity to the respective one in the other group.

As shown in FIG. 8, each of the two memory socket 901 on the motherboard 9 has an end formed with a latch 901. The latch 901 can be held in a latched position, as shown in FIG. 8, for fastening a circuit board card (not shown), or be pulled to an open position, as shown in FIG. 9, for extraction of the circuit board card.

However, it is necessary for the motherboard 9 to preserve an interval W between the two adjacent memory sockets 90 in order to allow the opposed latches 901 of the memory sockets 90 to be completely pulled to the respective open positions, as shown in FIG. 9. The interval W apparently occupies an area of the motherboard 9 and is undesired in the motherboard where space is at a premium.

SUMMARY OF INVENTION

It is an object of the invention to provide a socket to improve the space utilization of a motherboard. The socket includes a housing and a first latch. The housing includes a first side plate and a second side plate. The first and second side plates are parallel to each other and co-define an elongated slot therebetween for reception of a board and two enlarged end openings at opposite ends of the slot. The first latch includes a first axle, a first body and a first fastening portion. The first axle is received in one of the end openings of the housing and pivotably coupled to the housing. The first body has one end joined to the first axle and the other end to the first fastening portion. The first fastening portion is constructed for engagement with the board. In particular, the lateral width of the first body of the first latch in the direction along the width the first side plate of the housing is smaller than that of the end opening of the housing in the same direction.

Preferably, the socket further includes a second latch having a second axle, a second body and a second fastening portion. The second latch is pivotably coupled to the housing at the other end of the slot. The second body has one end joined to the second axle and the other end to the second fastening portion. The second fastening portion is constructed for engagement with the board. In addition, the lateral width of the second body of the second latch in the direction along the width the second side plate of the housing is smaller than that of the other end opening of the housing in the same direction.

The first body and second body are staggered in position so that the two sockets can be arranged end to end on a circuit board and put as closer as required, and thereby save space and maximize the space utilization of the circuit board.

It is another object of the invention to provide a motherboard using at least two aforementioned sockets. The motherboard includes a circuit board, a first socket and a second socket. The first and second sockets are arranged end to end on the circuit board and both use to the aforementioned socket in structure.

Further, since the first and second sockets are identical in structure, the injection mould cost for making the sockets can be reduced and the sockets can be assembled on the motherboard in a more convenient way.

Further features and advantages of the present invention will be appreciated by review of the following detailed description of the invention.

BRIEF DESCRIPTION OF DRAWINGS

The invention will now be described by way of example with reference to the accompanying drawings wherein.

DETAILED DESCRIPTION OF EMBODIMENTS

Figure 1:
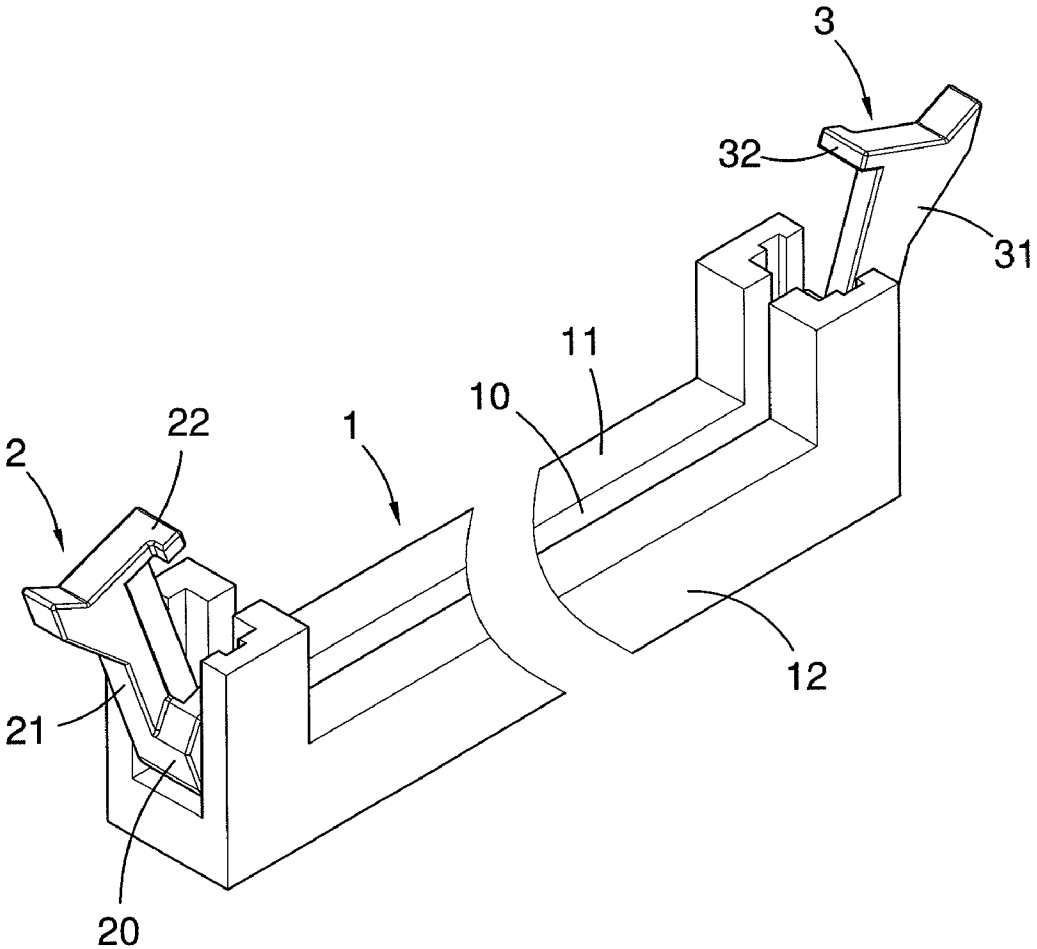
FIG. 1 is a perspective view of a socket in accordance with one embodiment of the invention.
Figure 2:
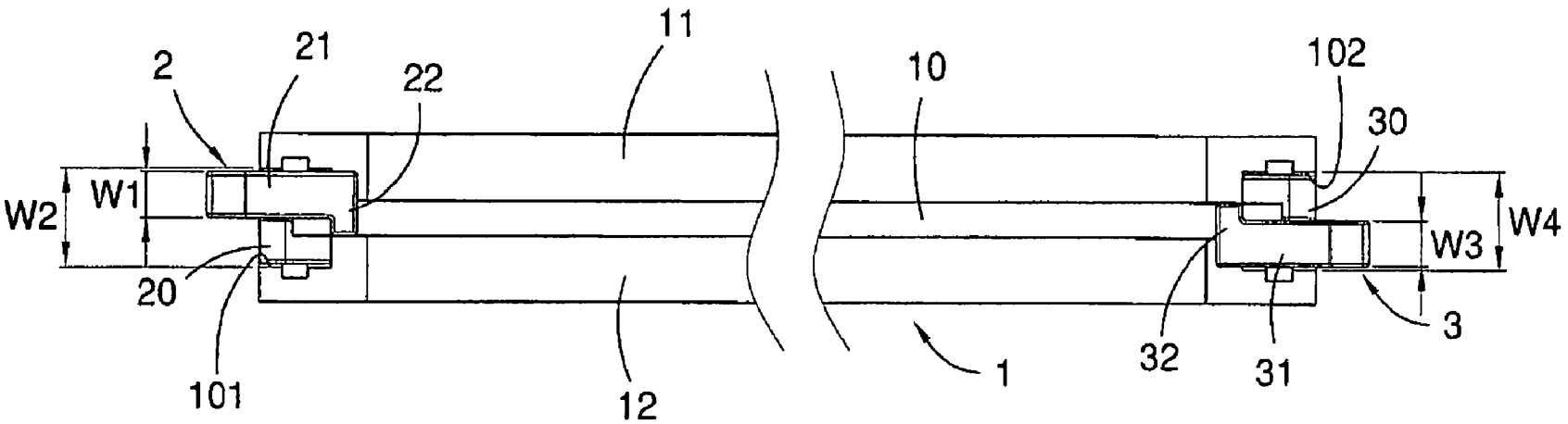
FIG. 2 is a top view of the socket in FIG. 1.

Referring now to FIGS. 1 and 2, a socket in accordance with one embodiment of the invention includes a housing 1, a first latch 2 and a second latch 3.

The housing 1 includes a first side plate 11 and a second side plate 12. The first side plate 11 and second side plates 12 are parallel to each other and co-define an elongated slot 10 therebetween for reception of a board 4 (FIG. 3) and two enlarged end openings 101, 102 at opposite ends of the slot 10.

As shown in FIG. 1, the first latch 2 includes a first axle 20, a first body 21 and a first fastening portion 22. The first axle 20 is received in the end opening 101 of the housing 1 and pivotably coupled to the housing 1. The first body 21 has its lower end joined to the first axle 20 and the upper end to the first fastening portion 22. Moreover, as shown in FIG. 2, the lateral width W1 of the first body 21 of the first latch 2 in the direction along the width of the first side plate 11 is smaller than the lateral width W2 of the end opening 101 of the housing 1 from the same direction. The first fastening portion 22 is constructed for engagement with one end of the board 4. In this embodiment, the first fastening portion 22 is, but not limited to, a protrusion or a latching projection extending from the first body 21 to enhance engagement with the board 4.

FIG. 2 is a top view of the socket in FIG. 1. As can be seen in FIG. 2, the second latch 3 includes a second axle 30, a second body 31 and a second fastening portion 32. The second axle 30 is received in the other end opening 102 of the housing 1 and pivotably coupled to the housing 1. Similar to the first body 21, the second body 31 has its lower end joined to the second axle 30 and the upper end to the second fastening portion 32. Moreover, the lateral width W3 of the second body 31 of the second latch 3 in the direction along the width of the second side plate 12 is smaller than the lateral width W4 of the other end opening 102 of the housing 1 in the same direction. The second fastening portion 32 is constructed for engagement with the other end of the board 4. In this embodiment, the second fastening portion 32 is, but not limited to, a protrusion or a latching projection extending from the second body 31 to enhance engagement with the board 4.

Figure 3:
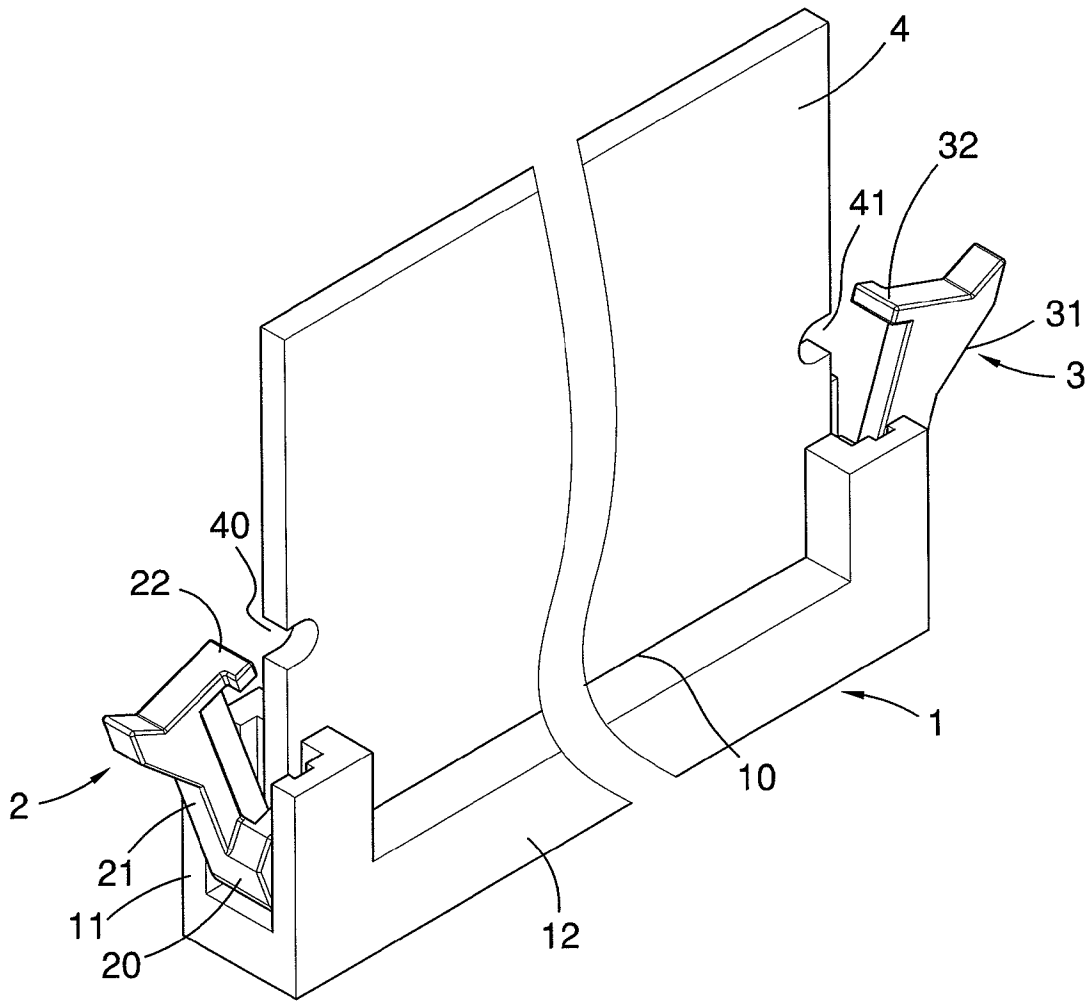
FIG. 3 illustrates that a board is seated in the socket of FIG. 1.

FIG. 3 illustrates that the board 4 is seated in the socket, and the first body 21 and second body 31 are rotated about the respective first axle 20 and second axles 30 to the open positions. The board 4 has an edge portion received in the slot 10 of the housing 1 of the socket. The board 4 may be an interface card, an adapter card, a dual inline memory module (DIMM) or other types of circuit board card, or even just a dummy board with no electrical traces printed thereon. In this embodiment, the board 4 is a dual inline memory module with a first notch 40 and a second notch 41 at opposite ends thereof, and the socket is a specialized DIMM socket for the board 4. The first fastening portion 22 and the second fastening portion 32 of the socket are configured to be engaged in the first notch 40 and the second notch 41 of the board 4. FIG. 3 illustrates that the first fastening portions 22 and second fastening portion 32 are detached away from the corresponding notches 40 and 41 of the board 4 to release the board 4.

Figure 4:
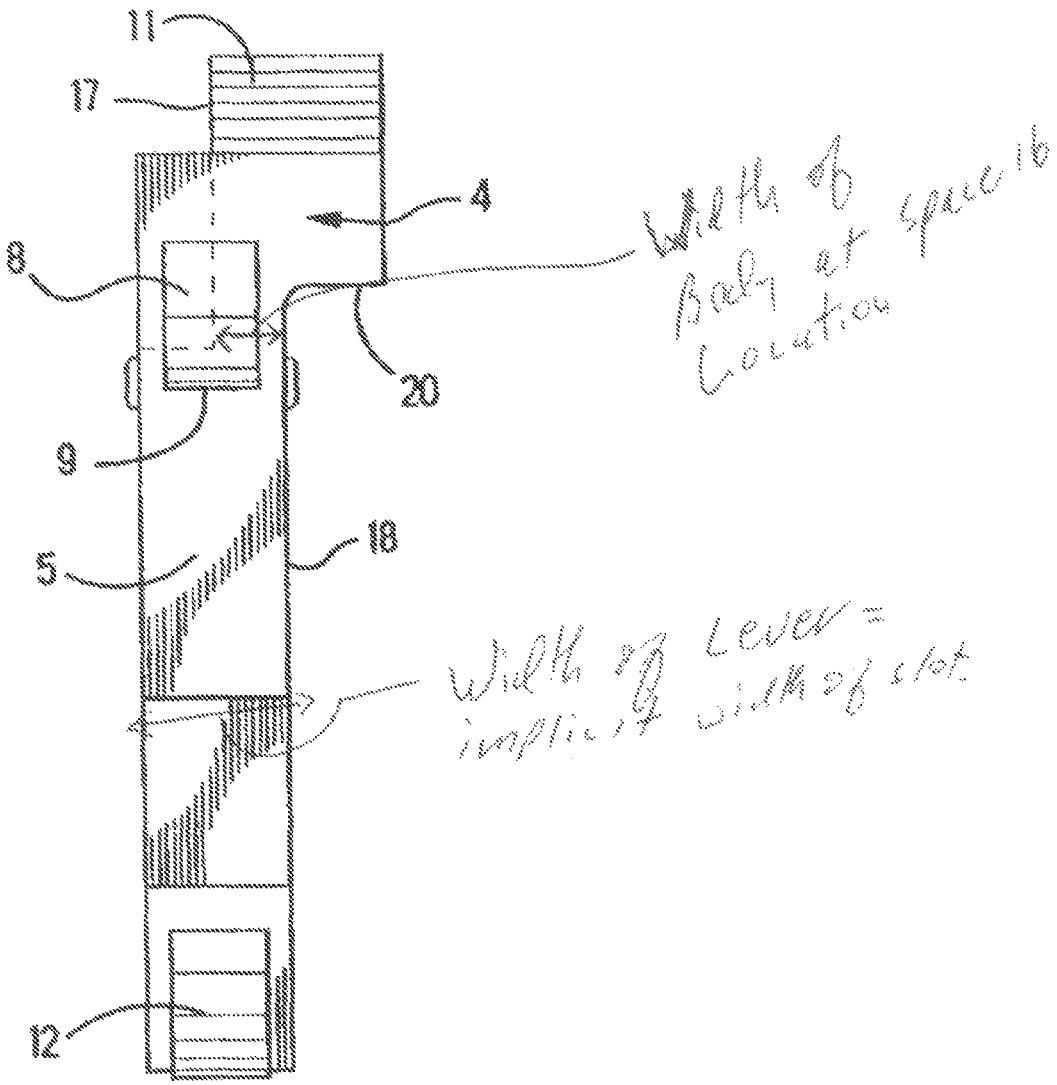
FIG. 4 is a view similar to FIG. 3, illustrating that the latches at the ends of the socket are in latched positions.

In contrast, FIG. 4 illustrates that the board 4 is seated in the socket while the first body 21 and the second body 31 are rotated to the closed or latched positions. At this time, the first fastening portion 22 and second fastening portions 32 of the socket are engaged in the first notch 40 and the second notch 41 of the board 4 respectively, and therefore the board 4 is securely seated in the socket and is not allowed to be extracted from the socket.

In particular, since the lateral width W1 of the first body 21 from the first side plate 11 is smaller than the lateral width W2 of the end opening 101 of the housing 1 and also the lateral width W3 of the second body 31 from the second side plate 12 is smaller than the lateral width W4 of the other end opening 102 of the housing 1, the first and second bodies 21, 31 of the socket are staggered in position. In doing so, two aforementioned sockets can be arranged end to end on a circuit board to save space, as will be discussed later.

In concerned with the injection mould cost, the first and second latches 2, 3 may be identical to each other in structure. On the other hand, the socket may be equipped with only one latch, either the first latch 2 or the second latch 3, rather than two latches so as to keep the cost down further.

In this embodiment, the lateral width W1 of the first body 21 in the direction along the width of the first side plate 11 equals one half of the lateral width W2 of the end opening 101 of the housing 1 in the same direction; and also the lateral width of the second body 31 in the direction along the width W3 of the second side plate 12 equals one half of the lateral width W4 of the other end opening 102 of the housing 1 in the same direction. In other words, the total lateral width (W1+W3) of the first and second bodies 21, 31 equals the lateral width (W2 or W4) of the either end opening 101 or 102 of the housing 1.

Figure 5:
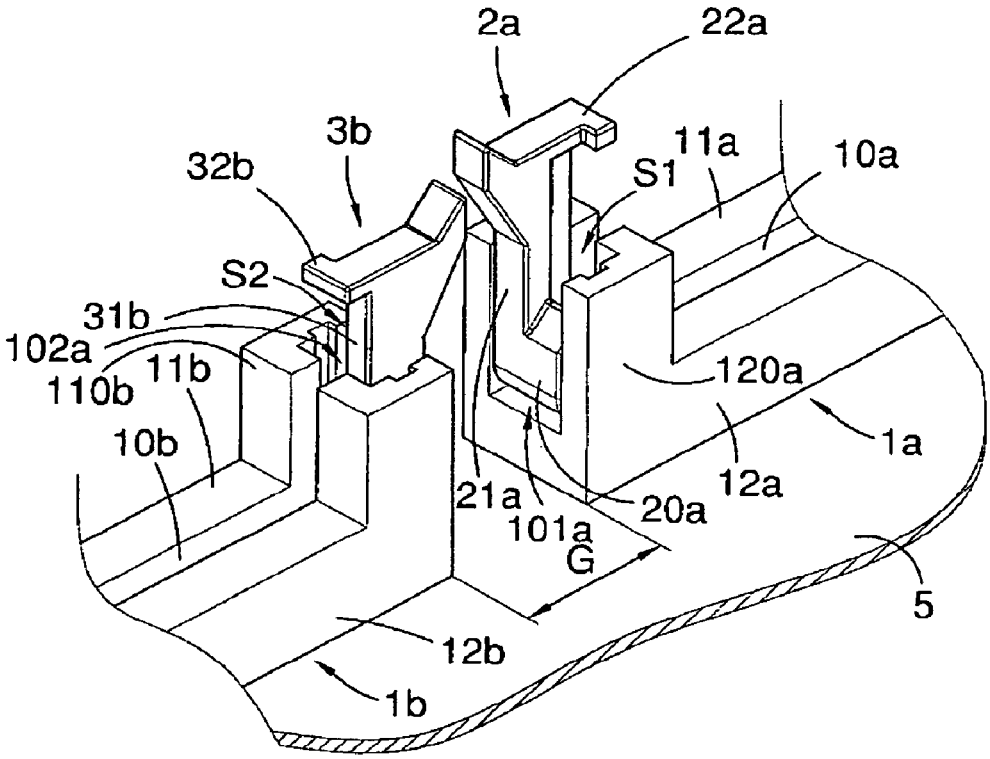
FIG. 5 illustrates that two sockets are arranged end to end on a circuit board with the adjacent latches in the open positions.

With reference to FIG. 5, a motherboard in accordance with one embodiment of the invention includes a circuit board 5, a first socket and a second socket. The first and second sockets are similar to the aforementioned socket. Specifically, the first socket includes a first housing 1*a* and a first latch 2*a*. The second socket includes a second housing 1*b* and a second latch 3*b*. For clarity, only partial portions of the sockets are depicted in FIG. 5.

The first housing 1*a* of the first socket includes a first side plate 11*a* and a second side plate 12*a* parallel to the first side plate 11*a*. The first and second side plates 11*a*, 11*b* define a first elongated slot 10*a* therebetween for reception of a first board (not shown) and an enlarged end opening 101*a* at one end of the first slot 10*a*. On the other hand, the first latch 2*a* of the first socket includes a first axle 20*a*, a first body 21*a* and a first fastening portion 22*a*. The first axle 20*a* is received in the end opening 101*a* of the first housing 1*a* and pivotably coupled to the first housing 1*a*. The first body 21*a* has its lower end joined to the first axle 20*a* and the upper end to the first fastening portion 22*a*. Similar to the first fastening portion 22 of FIG. 1, the first fastening portion 22*a* is constructed for engagement with the first board. Substantially all of the features on the first fastening portion 22 of FIG. 1 apply to the first fastening portion 22*a* and will not be discussed further herein. In this embodiment, the first fastening portion 22*a* is, but not limited to, a protrusion or a latching projection extending from the first body 21*a*. Moreover, as best seen in FIG. 5, the enlarged end opening 101*a* of the first housing 1*a* includes a space S1 which is defined among the first axle 20*a*, the first body 21*a* and an end portion 120*a* of the second side plate 12*a*.

The second housing 1*b* of the second socket includes a third side plate 11*b* and a fourth side plate 12*b* parallel to the third side plate 11*b*. The third side plate 11*b* and the fourth side plate 12*b* define a second elongated slot 10*b* therebetween for reception of a second board (not shown) and an enlarged end opening 102*a* at one end of the second slot 10*b*. On the other hand, the second latch 3*b* of the second socket includes a second axle (not shown, but similar to the second axle 30 of FIG. 2), a second body 31*b* and a second fastening portion 32*b*. The second axle (not shown) is received in the end opening 102*b* of the second housing 1*b* and pivotably coupled to the second housing 1*b*. The second body 31*b* has its lower end joined to the second axle and the upper end to the second fastening portion 32*b*. The second fastening portion 32*b* is constructed for engagement with the second board. Substantially all of the features on the second fastening portion 32 of FIG. 1 apply to the second fastening portion 32*a* and will not be discussed further herein. In this embodiment, the second fastening portion 32*a* is, but not limited to, a protrusion or a latching projection extending from the second body 31*a*. Moreover, as shown in FIG. 5, the enlarged end opening 102*b* of the second housing 1*b* includes a space S2 which is defined among the second axle, the second body 31*a* and an end portion 110*b* of the third side plate 11*b*.

Similarly, the first latch 2*a* and second latches 3*a* may be identical to each other in structure in concerned with the injection mould cost. Preferably, the lateral width of the first body 21*a* of the first latch 2*a* in the direction along the width of the first side plate 11*a* equals one half of the lateral width of the end opening 101*a* of the housing 1*a*. In addition, the lateral width of the second body 31*b* of the second latch 3*b* from the fourth side plate 12*b* of the second housing 1*b* equals one half of the lateral width of the end opening 102*b* of the second housing 1*b*. In other words, the total lateral width of the first and second bodies 21*a*, 31*b* equals the width of the end opening 101*a* or 102*b*.

It should be noted that the first and second latches 2*a* 3*b* are not limited to specific configuration as disclosed above, but may be formed in other types of construction as long as they are staggered. For example, the lateral width of the first body may equal two third of the lateral width of the end opening of the first opening, and the lateral width of the second body may equal one third of the lateral width of the end opening of the second housing such that the first and second bodies are staggered and will not be blocked by each other when the first and second latches are pulled to the open positions. Alternatively, the first body may be formed of two branches, and the second body, staggered with respect to the branches of the first body, can pass through the tunnel defined between the two branches of the first body while the first and second latches are pulled to the open positions.

Figure 6:
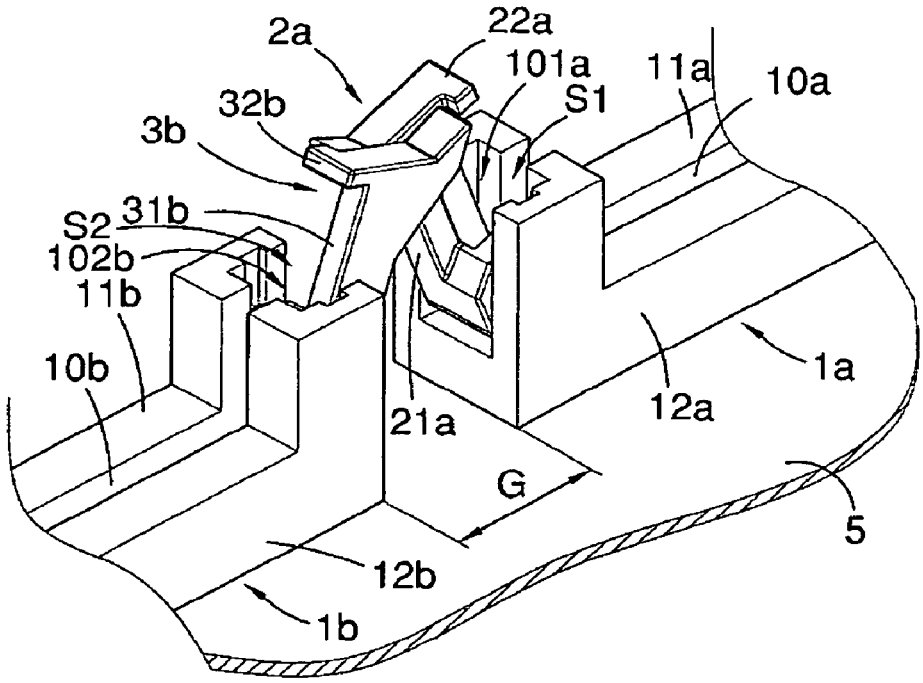
FIG. 6 is a view similar to FIG. 5, illustrating that the adjacent latches of the two sockets are in the latched positions.
Figure 5A:
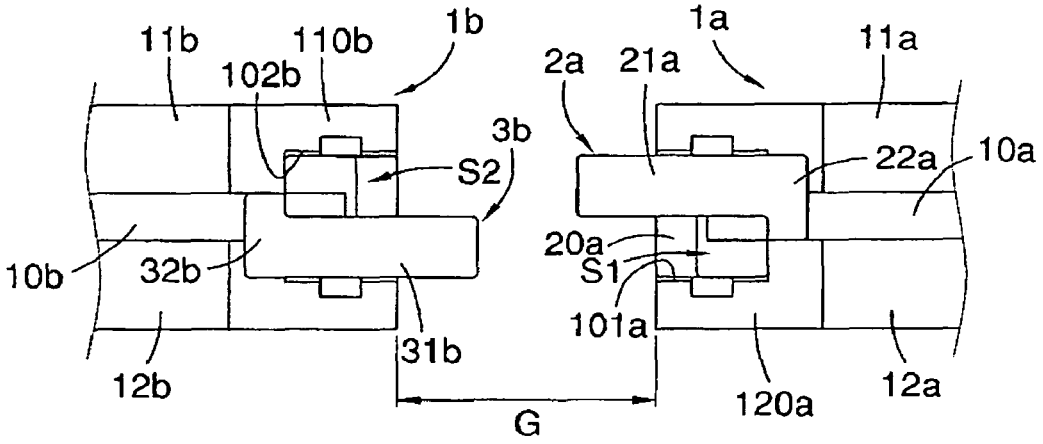
FIG. 5A is a top view of the sockets in FIG. 5.
Figure 6A:
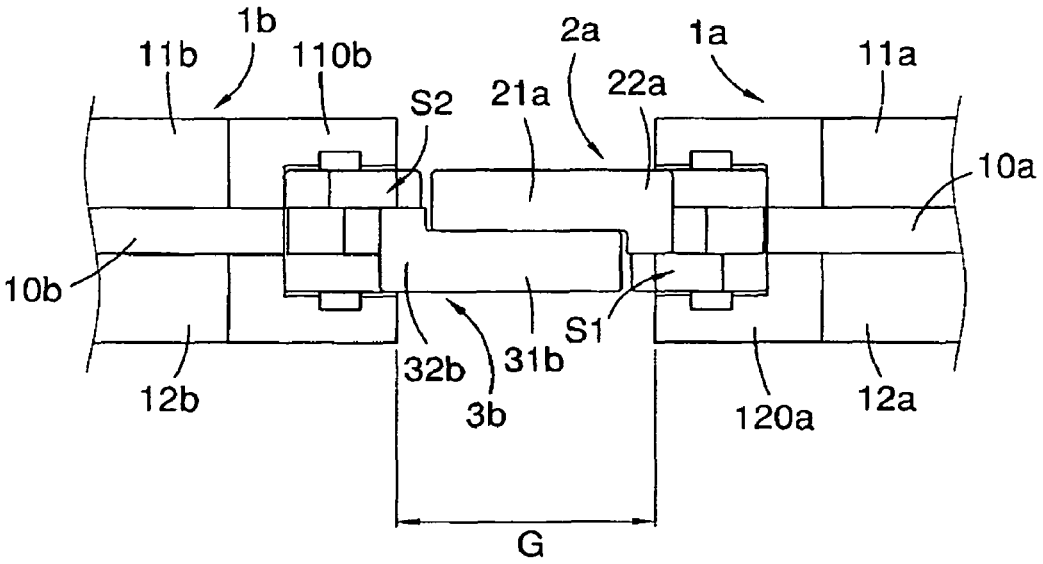
FIG. 6A is a top view of the sockets in FIG. 6.
Figure 7:
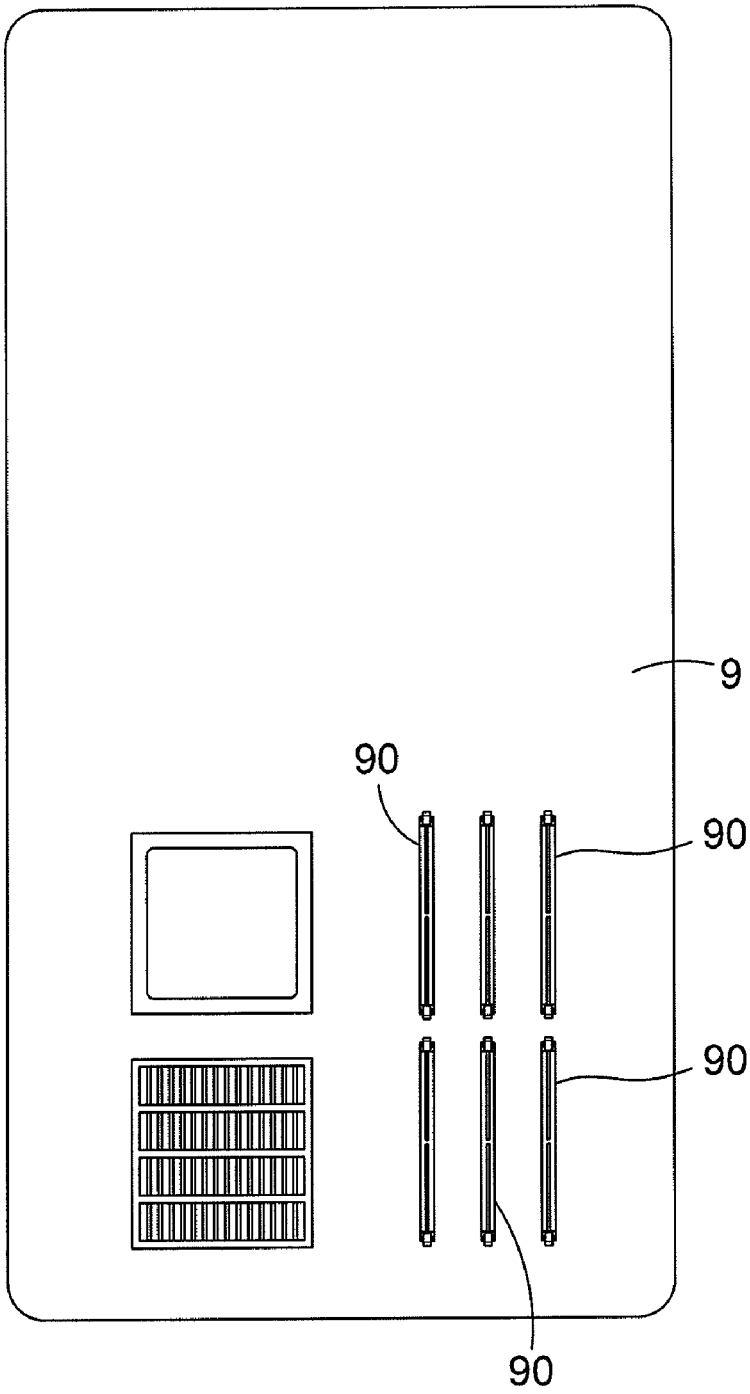
FIG. 7(PRIOR ART)
FIG. 7 is top view of a prior art motherboard.
Figure 8:
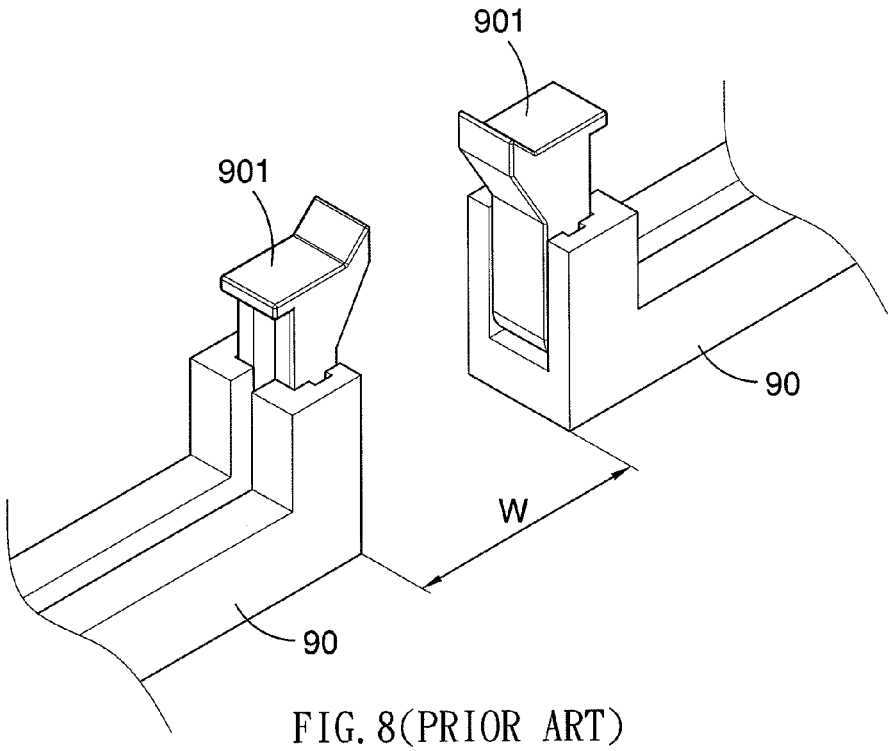
FIG. 8(PRIOR ART)
FIG. 8 is a perspective view of two prior art sockets with end latches in latched positions.
Figure 9:
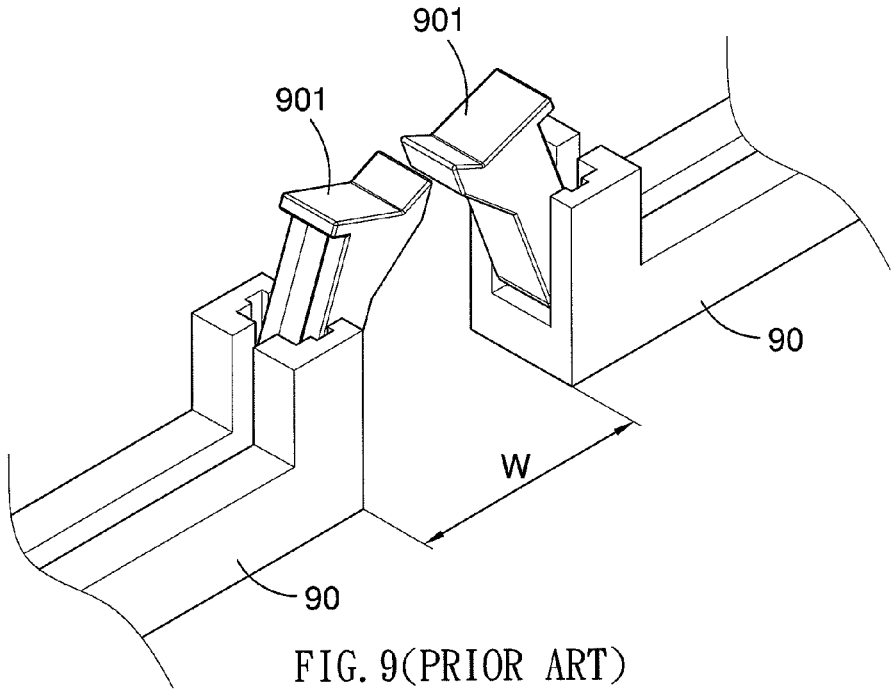
FIG. 9(PRIOR ART)
FIG. 9 is a view similar to FIG. 8, illustrating that the end latches of the prior art sockets are in open positions.

As shown in FIG. 5, the first and second sockets are arranged end to end, and the first body 21*a* of the first socket and the second body 31*b* of the second socket are disposed in the latched positions. The first body 21*a* of the first socket, proximal to the first side plate 11*a*, is aligned with the opposed space S2 defined among the second axle, the second body 31*b* and the end portion 110*b* of the third side plate 11*b* of the second socket. In contrast, the second body 31*b* of the second socket, proximal to the fourth side plate 12*b*, is aligned with the opposed space S1 defined among the first axle 20*a*, the first body 21*a* and the end portion 120*a* of the second side plate 12*a* of the first socket. As a result, the first body 21*a* of the first socket and the second body 31*b* of the second socket are staggered and will not be blocked by each other from moving to the open positions, as shown in FIGS. 6 and 6A. In such a manner, the gap G is quite small in comparison with the interval W in FIG. 8 or 9. In other words, the gap G between first housing 1*a* and the second housing 1*b* can be reduced or even brought down to zero if required, and thereby maximum the space utilization of the circuit board.

It will be appreciated that although a particular embodiment of the invention has been shown and described, modifications may be made. It is intended in the claims to cover such modifications which come within the spirit and scope of the invention.

The invention claimed is:

1. A motherboard selectively mounting a first board and a second board thereon, comprising:

a first socket including a first housing and a first latch; the first housing including a first side plate and a second side plate parallel to the first side plate; the first and second side plates together defining a first elongated slot therebetween for reception of the first board and an enlarged end opening at one end of the first slot; and the first latch including a first axle, a first body and a first fastening portion; the first axle received in the end opening of the first housing and pivotably coupled to the first housing; the first body having one end joined to the first axle and the other end to the first fastening portion; the lateral width of the first body of the first latch in a direction along the width of the first side plate is smaller than that of the end opening of the first housing in the direction; and the first fastening portion constructed for engagement with the first board; and a second socket including a second housing and a second latch; the second housing including a third side plate and a fourth side plate parallel to the third side plate; the third and fourth side plates together defining a second elongated slot therebetween for reception of the second board and an enlarged end opening at one end of the second slot; and the second latch including a second axle, a second body and a second fastening portion; the second axle received in the end opening of the second housing and pivotably coupled to the second housing; the second body having one end joined to the second axle and the other end to the second fastening portion; the lateral width of the second body of the second latch in a direction along the width of the third side plate is smaller than that of the end opening of the second housing in the direction; and the second fastening portion constructed for engagement with the second board;

wherein the first socket and the second socket are arranged end to end; the first body of the first latch of the first socket is aligned with a space of the end opening of the second housing defined among the second axle, the second body and an end portion of the third side plate of the second socket; and the second body of the second latch of the second socket is aligned with a space of the end opening of the first housing defined among the first axle, the first body and an end portion of the second side plate of the first socket.

2. The motherboard of claim 1, wherein the first fastening portion of the first latch is a protrusion extending from the first body, and the second fastening portion of the second latch is a protrusion extending from the second body.

3. The motherboard of claim 1, wherein the lateral width of the first body of the first latch of the first socket in a direction along the width of the first side plate equals half of the lateral width of the end opening of the first housing; and the lateral width of the second body of the second latch of the second socket in the direction equals half of the lateral width of the end opening of the second housing.

4. The motherboard of claim 3, wherein the first latch of the first socket and the second latch of the second socket are identical.

5. A socket selectively mounting a board therein, comprising:

a housing including a first side plate and a second side plate parallel to the first side plate;

the first plate and the second side plate together defining an elongated slot therebetween for reception of the board and an enlarged end opening at one end of the slot;

a first latch including a first axle a first body and a first fastening portion; the first axle received in the end opening of the housing and pivotably coupled to the housing; the first body having one end joined to the first axle and the other end to the first fastening portion; the first fastening portion constructed for engagement with the board; and a second latch including a second axle a second bod and a second fastening portion; the second latch pivotably coupled to the housing and received in an enlarged end opening defined by the first and second side plates of the housing at the other end of the slot; the second body having one end joined to the second axle and the other end to the second fastening portion; the second fastening portion constructed for engagement with the board;

wherein the total lateral width of the first body of the first latch and the second body of the second latch in a direction along the width of the first side plate equals the lateral width of the either end opening of the housing in the direction.

6. The socket of claim 5, wherein the first fastening portion of the first latch is a latching projection extending from the first body, and the second fastening portion of the second latch is a protrusion extending from the second body.

7. The socket of claim 5, wherein the lateral width of the first body of the first latch in the direction is half of that of the end opening of the housing in the direction; and the lateral width of the second body of the second latch in the direction is half of that of the other end opening of the housing in the direction.

8. The socket of claim 7, wherein the first and second latches are identical.

9. A motherboard selectively mounting a first board and a second board thereon, comprising:

a first socket including a first housing and a first latch; the first housing including a first side plate and a second side plate parallel to the first side plate; the first and second side plates together defining a first elongated slot therebetween for reception of the first board and an enlarged end opening at one end of the first slot; and the first latch including a first axle, a first body and a first fastening portion; the first axle received in the end opening of the first housing and pivotably coupled to the first housing; the first body having one end joined to the first axle and the other end to the first fastening portion; the first fastening portion constructed for engagement with the first board; and a second socket including a second housing and a second latch; the second housing including a third side plate and a fourth side plate parallel to the third side plate; the third and fourth side plates together defining a second elongated slot therebetween for reception of the second board and an enlarged end opening at one end of the second slot; and the second latch including a second axle, a second body and a second fastening portion; the second axle received in the end opening of the second housing and pivotably coupled to the second housing; the second body having one end joined to the second axle and the other end to the second fastening portion; the second fastening portion constructed for engagement with the second board;

wherein the first socket and the second socket are arranged end to end; and the total lateral width of the first body of the first latch of the first socket and the second body of the second latch of the second socket equals the lateral width of the end opening of the first or second housing.

* * * * *